US005248050A

United States Patent [19]

Janousch et al.

[11] Patent Number: 5,248,050

[45] Date of Patent: Sep. 28, 1993

[54] CAP HAVING EXPANDABLE GUARANTEE STRIP

[75] Inventors: Herwig Janousch, Bad Säckingen; Michael Kirchgessner, Binzen, both of Fed. Rep. of Germany; Franz T. Bartl, Allschwil, Switzerland

[73] Assignee: Crown Cork AG, Reinach, Switzerland

[21] Appl. No.: 905,087

[22] Filed: Jun. 24, 1992

Related U.S. Application Data

[63] Continuation of Ser. No. 692,273, Apr. 29, 1991, abandoned.

[30] Foreign Application Priority Data

Apr. 27, 1990 [CH] Switzerland ..... 1453/90

[51] Int. Cl.[5] ..... B65D 41/34

[52] U.S. Cl. ..... 215/252

[58] Field of Search ..... 215/252

[56] References Cited

U.S. PATENT DOCUMENTS 4,485,934 12/1984 Maguire ..... 215/252
4,526,282 7/1985 Dutt et al. ..... 215/252
4,530,436 7/1985 Wiedmer ..... 215/246
4,664,279 5/1987 Obrist et al. ..... 215/252
4,744,479 5/1988 Schöttli ..... 215/252

*Primary Examiner*—Allan N. Shoap
*Assistant Examiner*—Nova Stucker
*Attorney, Agent, or Firm*—Woodcock Washburn Kurtz Mackiewicz & Norris

[57] ABSTRACT

A tamper-evident screw cap for a bottle is disclosed. A guarantee strip on the cap possesses a predetermined breakage point at which the guarantee strip is able to be separated though its entire width. The predetermined breakage point most preferably comprises at least two ribs. Preferably, a window-shaped stress relief aperture is arranged near the predetermined breakage point to improve the expandability of the guarantee strip when the cap is being screwed on for the first time. In this instance, the stress relief aperture prevents the forces caused by the circumferential expansion of the guarantee strip from breaking the predetermined breakage point. When screwing the cap off for the first time, a flow of forces is created in the guarantee strip such that the stress relief openings are no longer effective and the guarantee strip fulfills its function by tearing or otherwise separating to indicate that the cap has been removed.

9 Claims, 6 Drawing Sheets

CAP HAVING EXPANDABLE GUARANTEE STRIP

This is a continuation of application Ser. No. 692,273, filed Apr. 29, 1991, now abandoned.

The present invention relates to plastic screw caps for the closure of a container. More specifically, the present invention relates to screw caps having a guarantee or tamper-evidencing function, where a first time unscrewing of the cap is detectable by the tearing of a guarantee strip.

BACKGROUND OF THE INVENTION

A problem with known tamper-evidencing caps is, in particular, that during closure of the container the guarantee strip must be somewhat expanded in order to be pushed over the bead on the bottle opening. At the same time the screw cap is rotated on to the bottle, there is a danger that a point of weakness typically provided in such guarantee strips will tear or remain deformed such that the guarantee strip no longer fulfills its function. On the other hand, the point of weakness must be so dimensioned that the unscrewing of the cap for the first time will not require the exertion of excessive force.

It is therefore an object of the present invention to create a screw cap wherein the guarantee strip can expand over the bead of a container opening without damage to the point of weakness, whereby the tamper-evidencing function will not be adversely effected when unscrewing the cap for the first time.

SUMMARY OF THE INVENTION

The present invention is based on the knowledge that the forces created by screwing on a cap for the first time are not the same as when unscrewing the cap for the first time. The caps of the present invention therefore provide a stress relief aperture so that when screwing the cap on for the first time the guarantee strip is able to expand circumferentially without the point of weakness being endangered. On the other hand, when unscrewing the cap, the forces created do not affect the relief aperture and thus causes circumferential expansion of the guarantee strip to a lesser degree than when screwing the cap on for the first time. This has the result that the guarantee strip tears, and thus remains able to provide evidence of first time unscrewing.

The stress relief aperture provided in accordance with the present invention can, depending upon the type of application, be in one of several preferred embodiments. It can, for example, take the form of an approximately vertical slit, open towards the lower edge of the guarantee strip, which extends through a part of the guarantee strip. In another embodiment, the relief aperture can also be formed as a window which is arranged at a distance from the lower edge of the guarantee strip. The lower edge of the guarantee strip will thus remain uninterrupted over its entire circumference, which can improve the tamper evidencing function. The window can be formed approximately as a rectangle, but could also be polygonal, round or exhibit another configuration. In certain embodiments, numerous neighboring relief openings are also provided.

It is of particular advantage if the tamper evidencing or guarantee strip exhibits a section on its circumference on which it is connected with the lower edge of the cap, and if it exhibits a complementary section on which it is connected to the lower edge of the cap by ribs which are able to tear off, whereby a point of weakness or predetermined breakage point is arranged on one or each of the two bordering regions between the sections. In these embodiments, the relief aperture is preferably arranged in a section of the circumference which is relatively firmly connected to the cap. If the guarantee strip has a strengthened retention element on the inner side of the complementary section, for example in the form of a bead, when unscrewing the cap, the ribs between the guarantee strip and the cap will tear first, while the predetermined breakage point will still hold. In the process of further unscrewing the cap, the predetermined breakage point will also tear since no appreciable expansion takes place. The ribs can run parallel or inclined to the direction of the circumference of the guarantee strip.

DETAILED DESCRIPTION OF THE PREFERRED EMBODIMENTS

Figure 1:
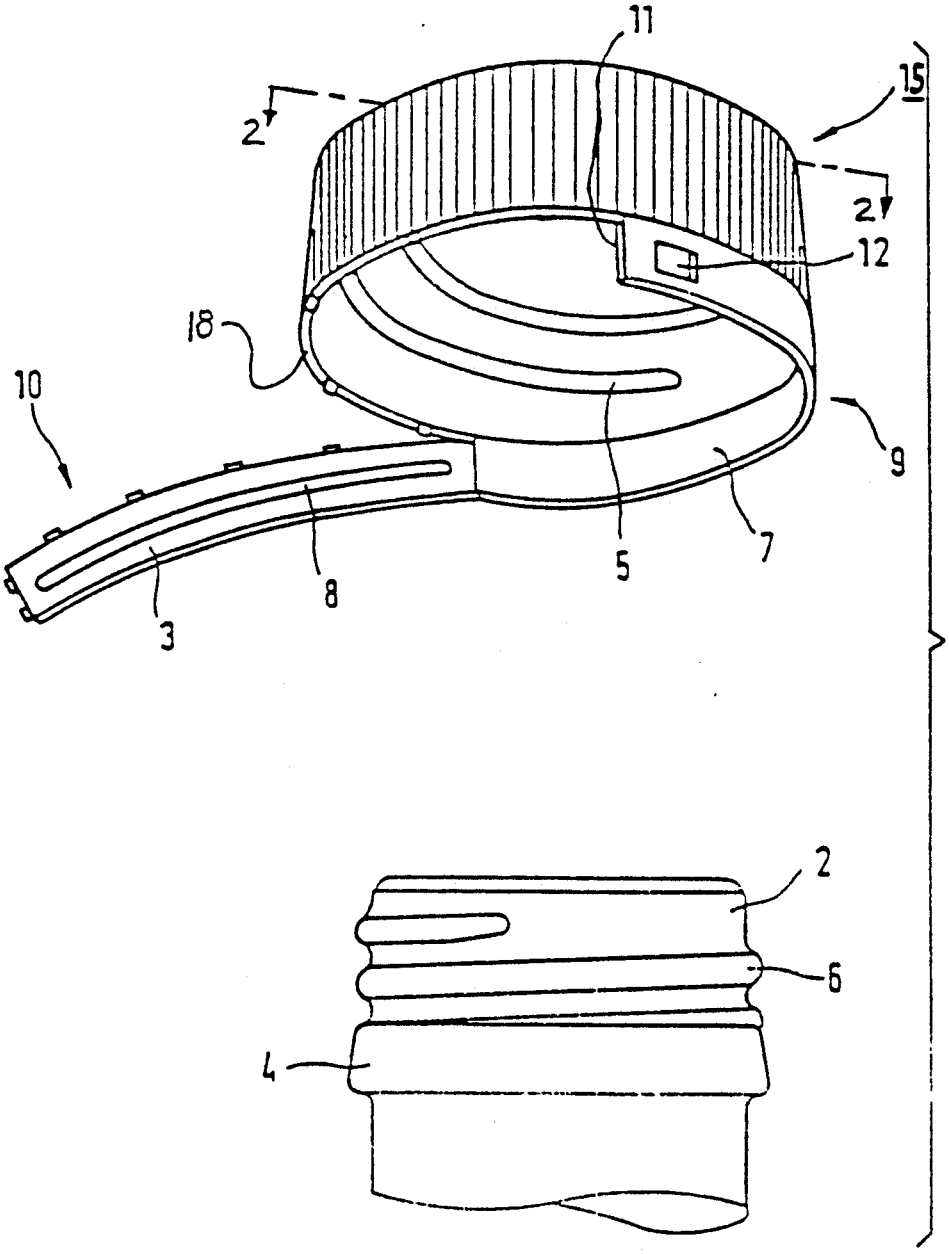
FIG. 1 is a view of a container opening and a cap made in accordance with the present invention exhibiting a torn guarantee strip after unscrewing.
Figure 2:
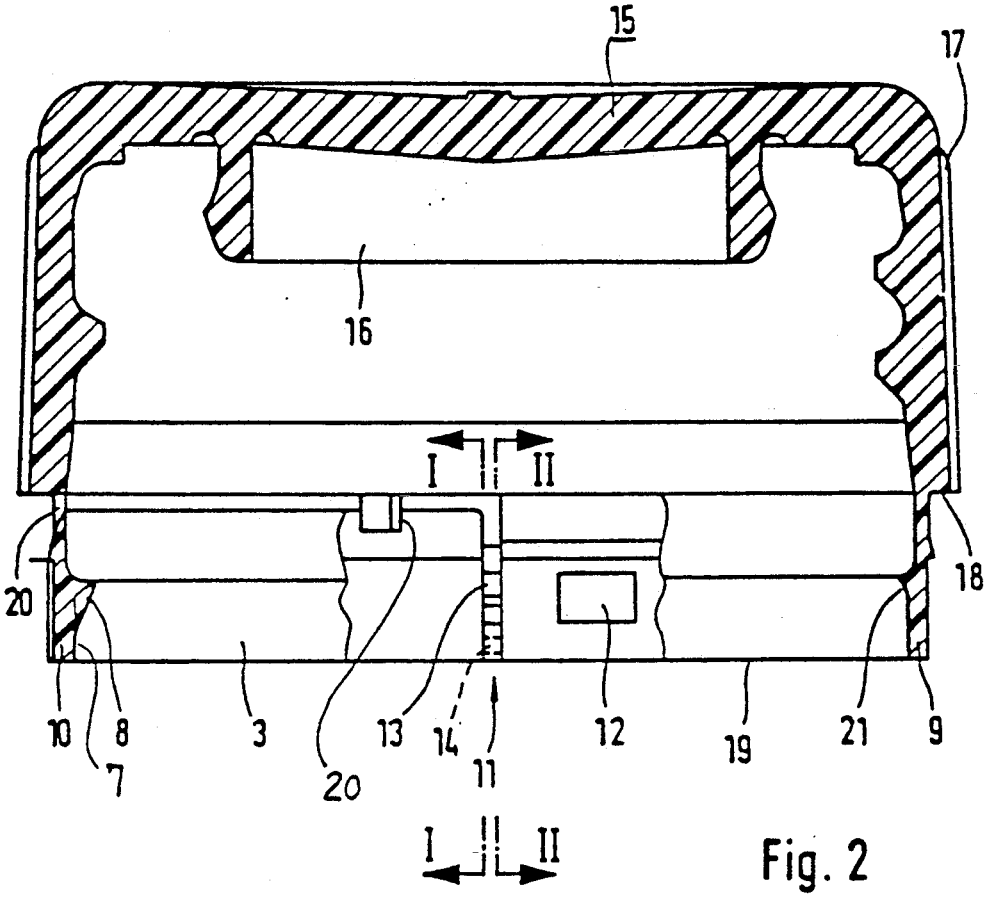
FIG. 2 is an enlarged cross-section through a screw cap according to the invention taken along line 2—2 of FIG. 1.

FIG. 1 shows a plastic screw cap 15 with an inside thread 5 that serves as a closure for a container opening 2 with an outside thread 6. These types of caps 15 are typically used as a closure for bottles, whereby, as a rule, reusable glass bottles with a standardized openings are employed. However, the caps 15 of the present invention can also be used with disposable glass or plastic bottles. In the case of reusable bottles, however, it is of greater significance that the guarantee strip 3 does not remain beneath the container bead 4 upon removal of the cap 15, since this would mean increased additional effort when cleaning the bottles. However, the recycling of disposable plastic bottles is also facilitated by this feature since the cap and guarantee strip may be of a different type of plastic than the bottle and thus cannot be recycled with the bottle. For this reason, the guarantee strip 3 exhibits a predetermined breakage point 11 through its circumference, which has the effect that the guarantee strip 3 can be removed from the container opening 2 and preferably remains attached to the cap 15. A thin film connection 11' may also be provided as an alternative embodiment of the predetermined breakage point.

The guarantee strip 3 preferably comprises a circumferential section 9 which is relatively firmly connected to the lower edge 18 of the screw cap 15 and a complementary section 10 which is able to tear away from the cap 15, as illustrated. On the inner side 7 of the guarantee strip 3, preferably on the complementary section 10, a retention element is disposed in the form of a bead 8 which, when screwing on the cap 15 for the first time, snaps under the bead 4 on the container opening 2 and in so doing causes the necessary tension in order to tear the guarantee strip 3 when unscrewing the cap for the first time.

A preferred embodiment of a screw cap 15 made in accordance with the present invention is described in further detail with reference to FIGS. 2–5. An inner seal 16 is preferably arranged on the base of the cap 15 to engage with the container opening (not shown). Alternatively, in place of this type of seal, the screw cap 15 could be provided with a seal insert as is well known in the art. The side wall of the cap is preferably provided with a knurl 17 to increase the grip of the consumer opening the bottle. The guarantee strip 3 is connected with the lower edge 18 of the cap 15 in the region of the complementary section 10 by a plurality of ribs 20. A strengthened bead 8, which serves as a retention element, is also arranged on the complementary section 10. It can be seen in FIG. 5 that the bead 8 extends through an approximate angle of $\alpha$ and blends at both ends into an engaging edge 21 which is preferably arranged on the circumferential section 9 of the guarantee strip 3 which is firmly connected to lower cap edge 18.

Figure 3:
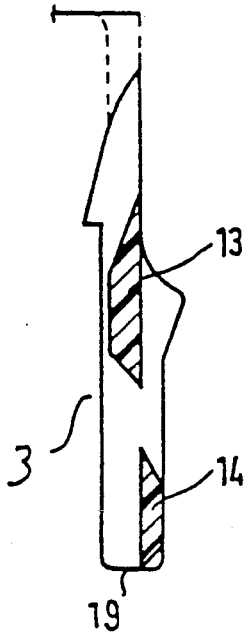
FIG. 3 is an enlarged cross-sectional view through the predetermined breakage point, taken along the line I—I in FIG. 2.
Figure 4:
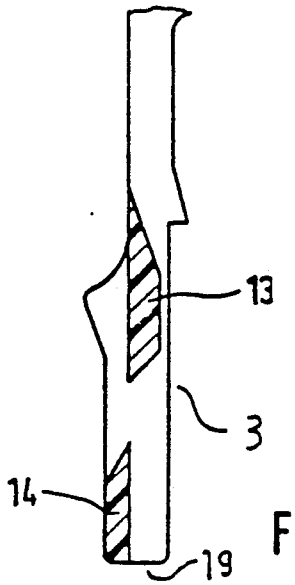
FIG. 4 is a cross-section through the predetermined breakage point taken along the line II—II in FIG. 2.
Figure 5:
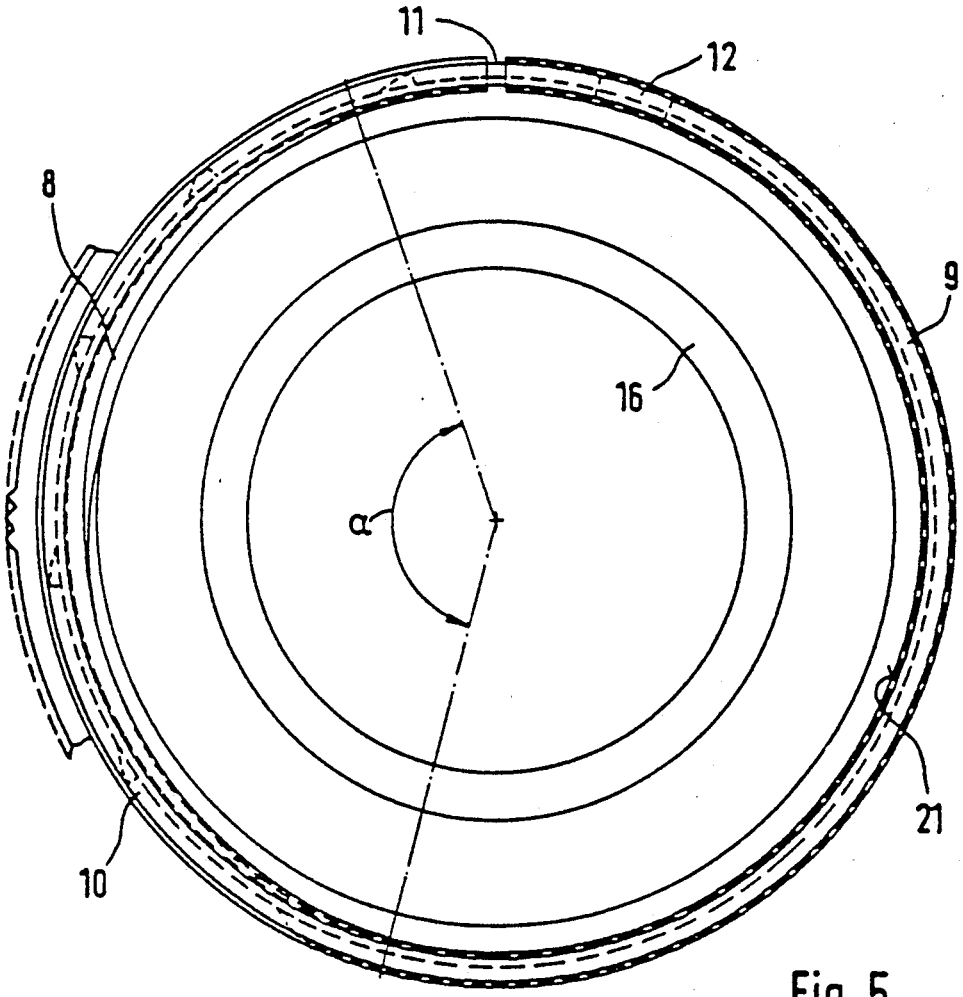
FIG. 5 is bottom a plan view of a screw cap made in accordance with the present invention.

Referring still to FIG. 5, the predetermined breakage point 11 lies in the bordering area between the circumferential and complimentary sections 9,10 and, as is shown in FIGS. 3–4, is formed by an upper rib 13 and a lower rib 14 arranged on the lower edge 19 of the guarantee strip 3. As seen in FIGS. 3–4, the ribs 13,14 are in cross-section preferably displaced vertically relative to one another in such a way that the inner wall of the upper rib 13 exhibits approximately the same diameter as the outer wall of the lower rib 14. This arrangement facilitates ejection of the cap 15 from an injection molding tool without damage to the ribs 13,14 occurring. The guarantee strip 3 is approximately wedge-shaped along its upper edge in a known way, which likewise facilitates exit from a forming tool. In the circumferential section 9, which is particularly visible on the right side of FIG. 2, the guarantee strip 3 is relatively firmly connected to the lower edge 18 of the cap 15. In a preferred embodiment of the present invention, a window-shaped aperture 12 is formed in the circumferential section 9.

Figure 6:
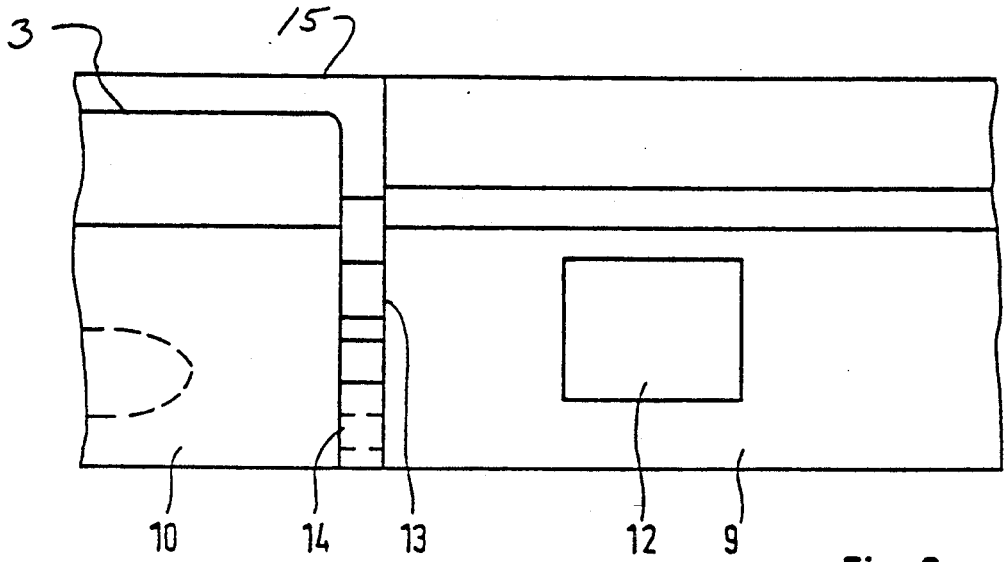
FIG. 6 is a partial elevation view of the predetermined breakage point and the relief aperture of a preferred embodiment of the cap of the present invention.
Figure 7:
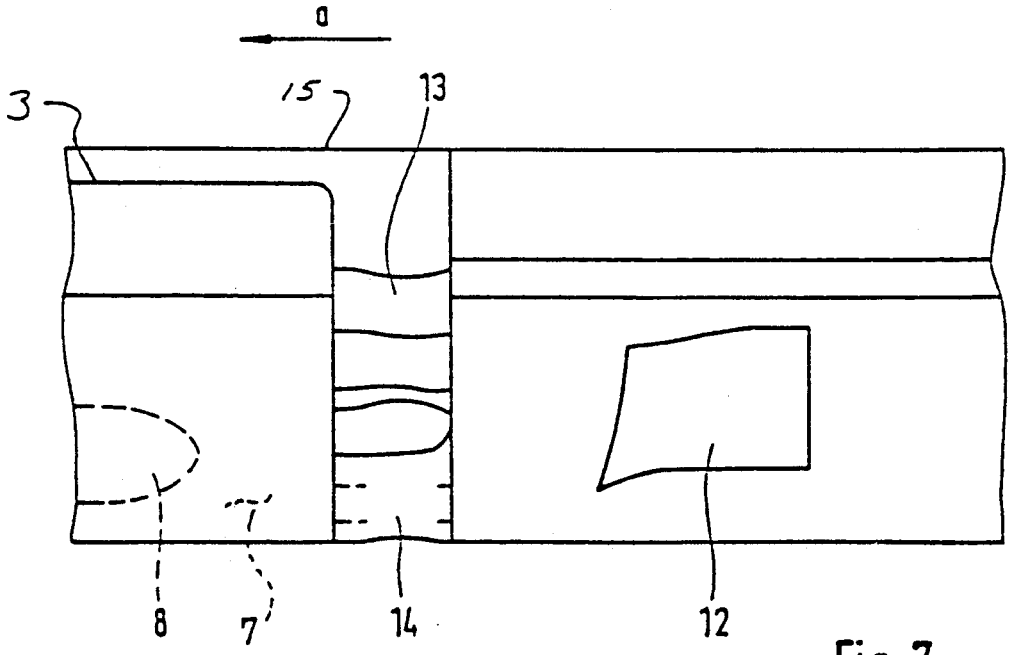
FIG. 7 illustrates the predetermined breakage point as shown in FIG. 6 at closure of the container opening.

Referring now to FIG. 6, an enlarged view of the window-shaped stress relief aperture 12 is shown. The stress relief aperture 12 is preferably formed in a similar way to the intermediate space between the ribs 13,14 described above. In a preferred embodiment, the total height of the guarantee strip 3 is about 0.197 inches (5 mm), thus the stress relief aperture 12 possesses a very small dimension. The optimum arrangement and configuration of the stress relief aperture 12, in particular its relative position to the predetermined breakage point 11, is dependent upon several parameters including the elasticity of the cap material, the dimensions of the predetermined breakage points and the wall thickness of the guarantee strip.

FIGS. 6–9 illustrate the action of the relief aperture 12 at different stages during the screwing on and unscrewing of the cap 15. FIG. 6 shows the guarantee strip 3 in an unloaded condition, in particular before the cap is screwed on for the first time. The ribs 13,14 of the predetermined breakage point are free of tension and the window-shaped stress relief aperture 12 is shown as a rectangle, without distortion. During closure of the container opening, illustrated in FIG. 7, the cap is turned in the direction of rotation shown by arrow a. The bead 8, shown in phantom on the inner side 7 of the guarantee strip 3, slips over the surrounding bead 4 of the container opening (shown in FIG. 1) which causes an expansion of the guarantee strip 3 in the direction of its circumference. The expansion affects the ribs 13,14 as well, which are somewhat deformed as shown. The expandability is, however, increased through the stress relief aperture 12, which itself expands and deforms at the same time, as can be observed by comparing FIG. 6 and FIG. 7. After engagement of the retention element 8 beneath the bead 4 of the container opening, the guarantee strip 3 reassumes the tension free position, similar to that shown in FIG. 6.

Figure 8:
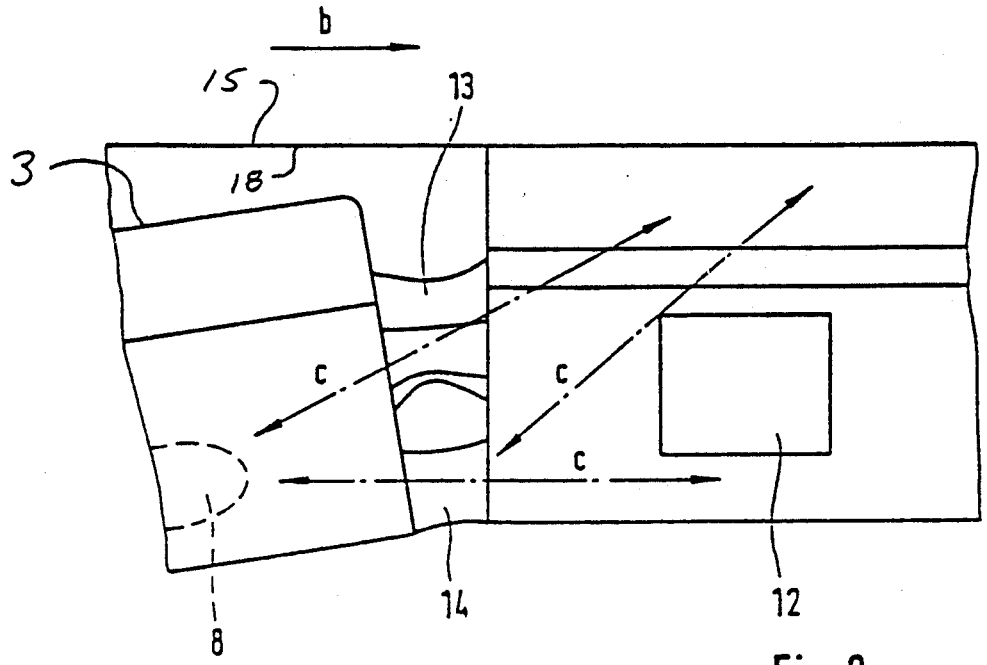
FIG. 8 illustrates the predetermined breakage point as shown in FIG. 6 when screwing off the cap for the first time.

The cap 15 of the present invention as it appears when unscrewing the cap for the first time is shown in FIG. 8. The cap 15 is turned in the direction shown by arrow b. Since the retention element 8 is no longer able to slip over the bead 4 of the container opening, the ribs 20 on the complementary section 10 (seen in FIG. 1) will tear. The predetermined breakage point 11 or point of weakness is, at this stage of unscrewing, submitted to greater expansion, as shown in FIG. 8, however, the ribs 13,14 are not yet torn. Starting at the end of the retention element 8, lines of force illustrated by arrows c, run both in the direction of the circumference and inclined against the lower edge 18 of the cap 15. However the stress relief aperture 12 at the same time is not affected. These forces thus cause no appreciable expansion, so that the tensile forces are fully effective on the predetermined breakage points, preferably defined by the ribs 13,14.

Figure 9:
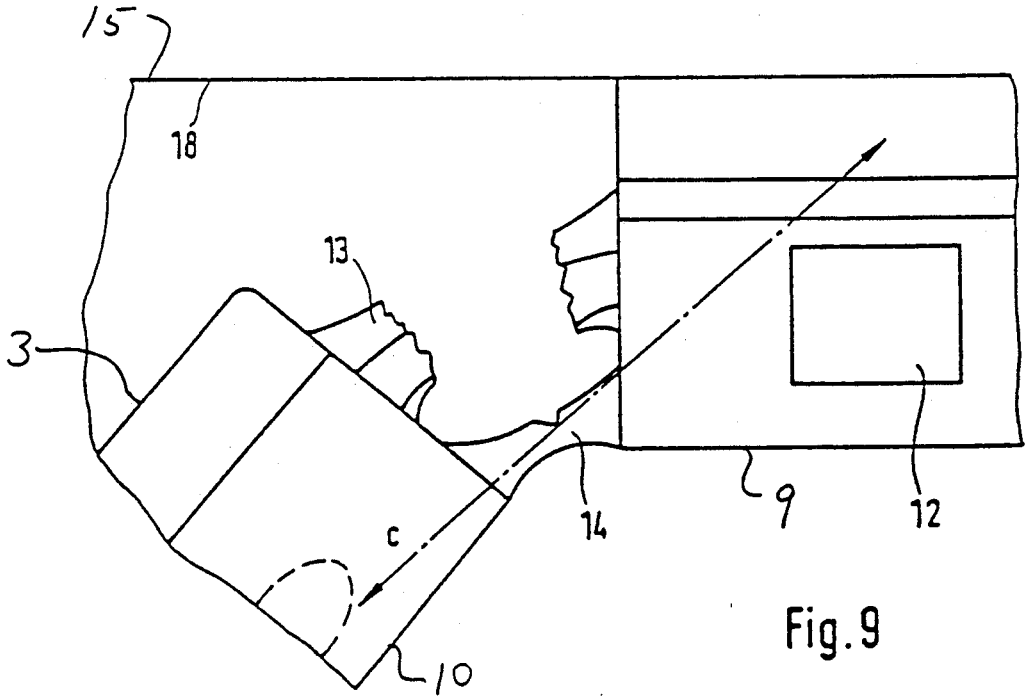
FIG. 9 illustrates the predetermined breakage point according to FIG. 8 at a further stage, w a torn upper rib.

FIG. 9 illustrates a further stage of the unscrewing procedure, at a point where the upper rib 13 has already been torn. The complementary section 10 now assumes an even greater angle to the lower cap edge 18, with respect to the circumferential section 9 which is firmly connected to the lower cap edge 18. The lines of force shown by arrows c now run only through the lower rib 14 and are inclined in such a way that the stress relief aperture 12 will not be adversely affected on completion of the tearing off procedure. Further expansion of the cap 15 in the direction of unscrewing shown by arrow b will also cause tearing of the lower rib 14 so that the condition shown in FIG. 1 is finally reached.

Figure 10:
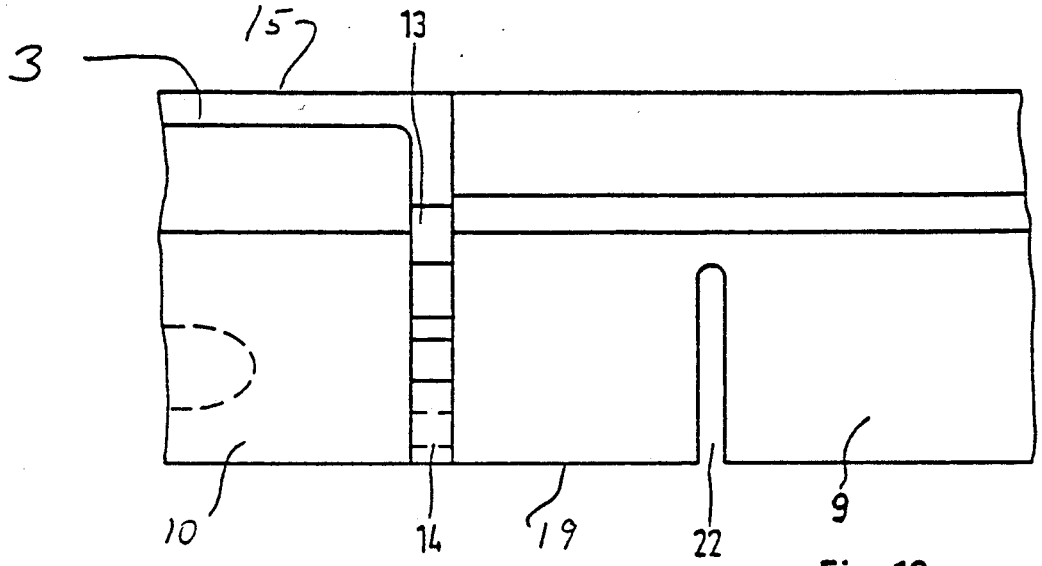
FIG. 10 depicts another embodiment of the cap of the present invention with a slit-shaped relief aperture.

Referring now to FIG. 10 there is illustrated another embodiment of the cap 15 of the present invention with a stress relief opening in the form of a slit 22 in the circumferential section 9 of the guarantee strip 3 that extends vertically to the lower edge of the cap 18. The effect is similar to that caused by the window-shaped stress relief aperture 12 discussed above with reference to FIGS. 1–9, whereby the flow of forces in the direction of the circumference at the lower edge 18 of the guarantee strip 3 is interrupted by the slit 22.

Figure 11:
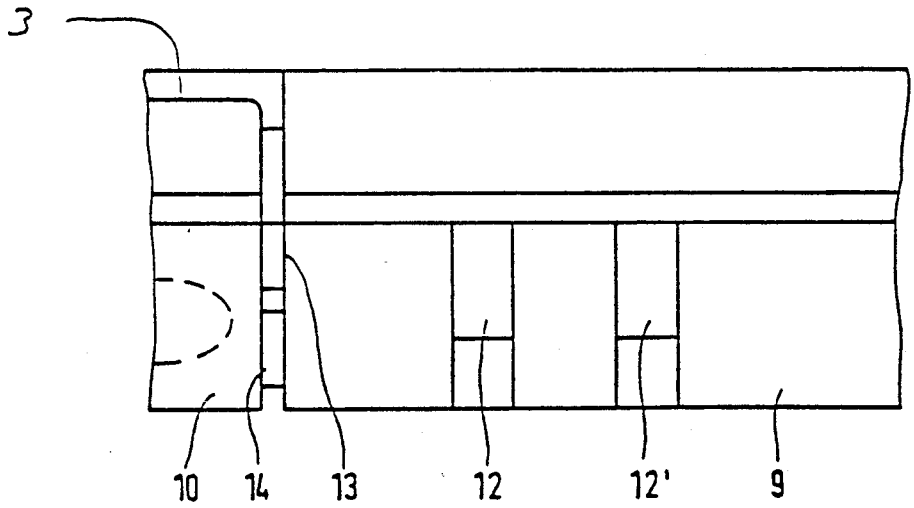
FIG. 11 depicts another embodiment of the cap of the present invention with two neighboring relief apertures.

FIG. 11 shows still another embodiment of the cap 15 of the present invention wherein two stress relief apertures 12 and 12' are formed in the circumferential section 9 as upright rectangles. Further stress relief apertures (not shown) could be arranged on the fixed circumferential section 9 if desired, in particular at its other end relative to the complimentary section 10.

Although certain embodiments have been described above with a great deal of specificity, these embodiments are meant to be illustrative of the present invention and do not limit its scope. Accordingly, reference should be made to the appended claims to ascertain the full scope of the present invention.

What is claimed is:

1. A plastic screw cap for closing a container opening comprising:

a guarantee strip disposed circumferentially around a lower edge of the cap from a first end to a second end, the guarantee strip being adapted to engage an annular bead on the container opening and comprising at least one retention element on an inner side thereof that, when screwing on the cap for the first time, is arranged to slide over the annular bead on the container and that, when unscrewing the cap for the first time, causes tearing of the guarantee strip, the guarantee strip further comprising:

at least one predetermined breakage point that is able to be separated though its entire height, said predetermined breakage point being formed by at least an upper and an lower rib connecting the ends of the guarantee strip across a separation space, said lower rib being disposed approximately at the lower edge of the guarantee strip; and at least one stress relief aperture which is formed as a rectangular window, not continuous with said separation space, disposed in close proximate relation to the predetermined breakage point and being approximately positioned on a level substantially between the upper rib and the lower rib, whereby the guarantee strip is permitted to expand when being screwed on for the first time.

2. A screw cap according to claim 1, wherein the guarantee strip comprises a circumferential section which is connected to the lower edge of the cap, and further comprises a complementary section which is connected to the lower edge of the cap by frangible ribs, whereby a predetermined breakage point is provided between the circumferential and complementary sections.

3. A screw cap according to claim 2, wherein the inner side of the guarantee strip comprises a strengthened retention element disposed on the complementary section.

4. A screw cap according to claim 3, wherein the strengthened retention element comprises a bead which extends over at least a portion of the complementary section.

5. A screw cap according to claim 2, wherein the stress relief aperture is arranged on the circumferential section.

6. A screw cap according to claim 5, wherein a stress relief aperture is disposed on each end of the circumferential section.

7. A screw cap according to claim 1, wherein two stress relief apertures are disposed next to the predetermined breakage point.

8. A screw cap according to claim 1, wherein the ribs of the predetermined breakage point are displaced vertically in relation to one other.

9. A plastic screw cap for closing a container opening, comprising:

a guarantee strip disposed circumferentially around a lower edge of the cap from a first end to a second end, the guarantee strip being adapted to engage an annular bead on the container opening and comprising at least one retention element on an inner side thereof that, when screwing on the cap for the first time, is arranged to slide over the annular bead on the container and that, when unscrewing the cap for the first time, causes tearing of the guarantee strip, the guarantee strip further comprising:

at least one predetermined breakage point that is able to be separated through its entire height, said predetermined breakage point being formed by at least an upper and lower rib connecting the ends of the guarantee strip across a separation space; and at least one but no more than two stress relief apertures in the guarantee strip, not continuous with said separation space, disposed in close proximate relation to the predetermined breakage point for permitting the guarantee strip to expand when being screwed on for the first time.

* * * * *